US005799367A

United States Patent [19]

Simon et al.

[11] Patent Number: 5,799,367

[45] Date of Patent: Sep. 1, 1998

[54] FLOOR MOUNTED DOORSTOP HAVING ADJUSTABLE RIGIDITY

[75] Inventors: Martin S. Simon; Ira J. Simon, both of Long Beach, Calif.

[73] Assignee: Triangle Brass Manufacturing Company, Los Angeles, Calif.

[21] Appl. No.: 539,416

[22] Filed: Oct. 5, 1995

[51] Int. Cl.[6] ..... E05F 5/06

[52] U.S. Cl. ..... 16/86 A; 292/DIG. 15; 292/DIG. 19

[58] Field of Search ..... 16/86 A, 86 R, 16/97, 107, 86 B, 86 C, 85; 292/DIG. 15, DIG. 19

[56] References Cited

U.S. PATENT DOCUMENTS

| | | | |
|---|---|---|---|
| 913,748 | 3/1909 | Mefford | 16/86 A |
| 1,128,105 | 2/1915 | Cheston | 16/86 A |
| 1,299,416 | 4/1919 | Atwood | 16/86 A |
| 1,533,687 | 4/1925 | Beck et al. | 292/DIG. 19 |
| 1,627,825 | 5/1927 | Beck et al. | 16/86 A |
| 1,657,313 | 1/1928 | Mitchell | 16/86 B |
| 1,858,541 | 5/1932 | Duffy | 16/86 A |
| 2,517,966 | 8/1950 | Boye | 16/86 A |
| 2,617,140 | 11/1952 | Desy | 16/86 A |
| 2,899,703 | 8/1959 | Johnson | 16/86 A |
| 2,988,392 | 6/1961 | Kuo | 16/86 A |
| 3,864,785 | 2/1975 | Hoppock | 16/86 |
| 4,505,502 | 3/1985 | Tomitz | 292/251.5 |
| 5,335,396 | 8/1994 | Dolan | 16/82 |

FOREIGN PATENT DOCUMENTS

| | | | |
|---|---|---|---|
| 1363837 | 5/1964 | France | 16/86 A |
| 6-229166 | 8/1994 | Japan | 16/86 A |
| 298431 | 10/1928 | United Kingdom | 16/86 B |

OTHER PUBLICATIONS

"Universal Floor Bumper", Baldwin Hardware Corp., Reading, PA.

"Model 2301" and Model 2302, Allgood–Modric Ltd., Alan Tye Designs, RDI, 297 Easton Rd., London NW1 3AQ, Figs. A–D.

*Primary Examiner*—Chuck Mah
*Assistant Examiner*—Donald M. Gurley
*Attorney, Agent, or Firm*—D'Alessandro & Ritchie

[57] ABSTRACT

A floor mounted doorstop employing an inner spacer having a first end and a second end, the first end disposed over the floor surface, an outer spacer having a first end and a second end, the first end disposed over the floor surface, and the outer spacer disposed around the inner spacer, a first rigid washer disposed over the second ends of said inner and outer spacers, a disk of a first height formed of a compressible material and having a first aperture formed therein disposed over the first rigid washer; a bushing of the first height disposed in the first aperture, a second rigid washer disposed over the disk, and fastening means for fastening the inner spacer, the outer spacer, the first rigid washer, the disk and the second rigid washer to the surface, the fastening means including means for compressing the outer spacer to a selected compression.

13 Claims, 4 Drawing Sheets

FLOOR MOUNTED DOORSTOP HAVING ADJUSTABLE RIGIDITY

BACKGROUND OF THE INVENTION

1. Field of the Invention

The present invention relates to the field of doorstop hardware. More particularly, the present invention relates to a floor mounted doorstop which incorporates a means to set the doorstop to a predetermined compression thus selecting the rigidity of the doorstop.

2. The Prior Art

Doorstops in the prior art are generally one of two types. A first general type of doorstop is mounted on a wall so that the face of the door striking the doorstop transmits force axially along the body of the doorstop. This type of doorstop typically has a rubber bumper which the door comes into contact with as the door strikes the doorstop. Examples of this type of doorstop are found in U.S. Pat. No. 2,899,703 to Johnson and U.S. Pat. No. 3,864,785 to Hoppock. Wall mounted doorstops are usually either secured to the wall in a position to contact the doorknob and thereby prevent the doorknob from hitting the wall as the door is opened or are positioned on the wall to contact the door before the door strikes the wall.

A second general type of doorstop is mounted on the floor in proximity to the door so that as the door is opened the lower portion of the door strikes the doorstop. Floor mounted doorstops commonly have single or multiple apertures in the base which are formed during the manufacturing process through which a screw, nail or other conventional fastener may be passed to fasten the doorstop to the floor. A common example of a floor mounted doorstop having both single and multiple means of attachment is a half dome doorstop which is screwed or nailed to the floor and which has a rubber bumper affixed to a lateral face where the door contacts the doorstop. In other floor mounted doorstops, a screw or nail is permanently fixed to the doorstop, and the doorstop is fastened to the floor by screwing or pounding the doorstop into the floor. These doorstops also usually have some arrangement for affixing a rubber bumper to the doorstop for contact with the door.

An example of a doorstop with a single fastener is the "Universal Floor Bumper" available from Baldwin Hardware Corporation of Reading, Pa. which incorporates a toroidal rubber insert which fits into a slot cut out of a cylindrical body. The door contacts the rubber toroid.

Unlike the wall mounted doorstops described above, as the door strikes a floor mounted doorstop, the force of the strike is directed to a lateral face of the doorstop. This causes a moment or rotational force to be applied to the base of the doorstop. As a consequence, when the doorstop is subject to high impact applications or after being repeatedly struck by the door, door stops in the prior art may be prone to mechanical failure or may have their functionality impaired by a loosening of the anchor bolting them to the floor.

In an attempt to remedy the problems of mechanical failure or impaired functionality, in the prior art doorstops with more than one point of attachment have been proposed. However, on several floor surfaces, most notably a concrete floor, it is very difficult to form the multiple holes in a floor so that they accurately match the multiple points of attachment on a doorstop. As a result the integrity of the attachment of the doorstop to the floor is often compromised.

In floor mounted doorstops of the prior art which are anchored to the floor with conventional flathead or Phillips screws or by nails, the doorstops are easily tampered with. Since doorstops are often placed in public buildings, such as schools, hospitals and office buildings, it is highly undesirable to have a doorstop which is easily tampered with.

The placement of doorstops in public buildings also requires that the doorstop be aesthetically pleasing. Doorstops, such as the Universal Floor Bumper, which are cylindrical in shape with a rubber bumper ringing one end of the doorstop have a modern look, and are considered desirable. However, such doorstops generally suffer from the durability and tamperability problems of floor mounted doorstops discussed herein. Furthermore, such doorstops provide no means for adjusting the compression of the doorstop so as to adjust the rigidity of the doorstop and prevent damage to the doorstop due to the force applied to the doorstop by the door.

SUMMARY OF THE INVENTION

The present invention is directed to a floor mounted doorstop designed for mounting in close proximity to a door. The doorstop comprises an inner spacer disposed on the floor, an outer spacer disposed on the floor and around the inner spacer, a first rigid washer disposed over the inner and outer spacers, a disk formed of a compressible material having an aperture formed therein disposed over the first rigid washer, a bushing disposed in the aperture, a second rigid washer disposed over said disk and a bolt which is passed through the inner spacer, the first rigid washer, the bushing and the second rigid washer to compress the outer spacer and securely fasten the doorstop to the surface with a desired rigidity which may be set by an appropriate torque wrench. The bolt may be specially keyed to render it more tamper resistant.

OBJECTS AND ADVANTAGES

Accordingly, it is an object of the present invention to provide an improved floor mounted doorstop which may be securely fastened to the floor.

It is another object of the present invention to provide an improved floor mounted doorstop which is very durable and works well in high impact applications.

It is yet another object of the present invention to provide a floor mounted doorstop which may not easily be tampered with.

It is yet another object of the present invention to provide a floor mounted doorstop which is aesthetically pleasing, but which may also be securely fastened to a floor and be highly durable.

It is another object of the present invention to provide a floor mounted doorstop with a single point of attachment which can be accurately mounted is very durable and works well in high impact applications.

Further objects and advantages will become apparent to those of ordinary skill in the art from the disclosure herein.

DETAILED DESCRIPTION OF A PREFERRED EMBODIMENT

Those of ordinary skill in the art will realize that the following description of the present invention is illustrative only and not in any way limiting. Other embodiments of the invention will readily suggest themselves to such skilled persons.

The present invention is directed to a floor mounted doorstop which absorbs the force of a door strike along a lateral face when the door is opened. The doorstop of the present invention utilizes an outer spacer, such that when the doorstop is fastened to the floor, the outer spacer is put under compression. This compression is advantageous in that it assists in keeping the doorstop securely fastened to the floor and provides rigidity to the doorstop so that the door stop is capable of withstanding very strong and repeated impacts.

Figure 1:
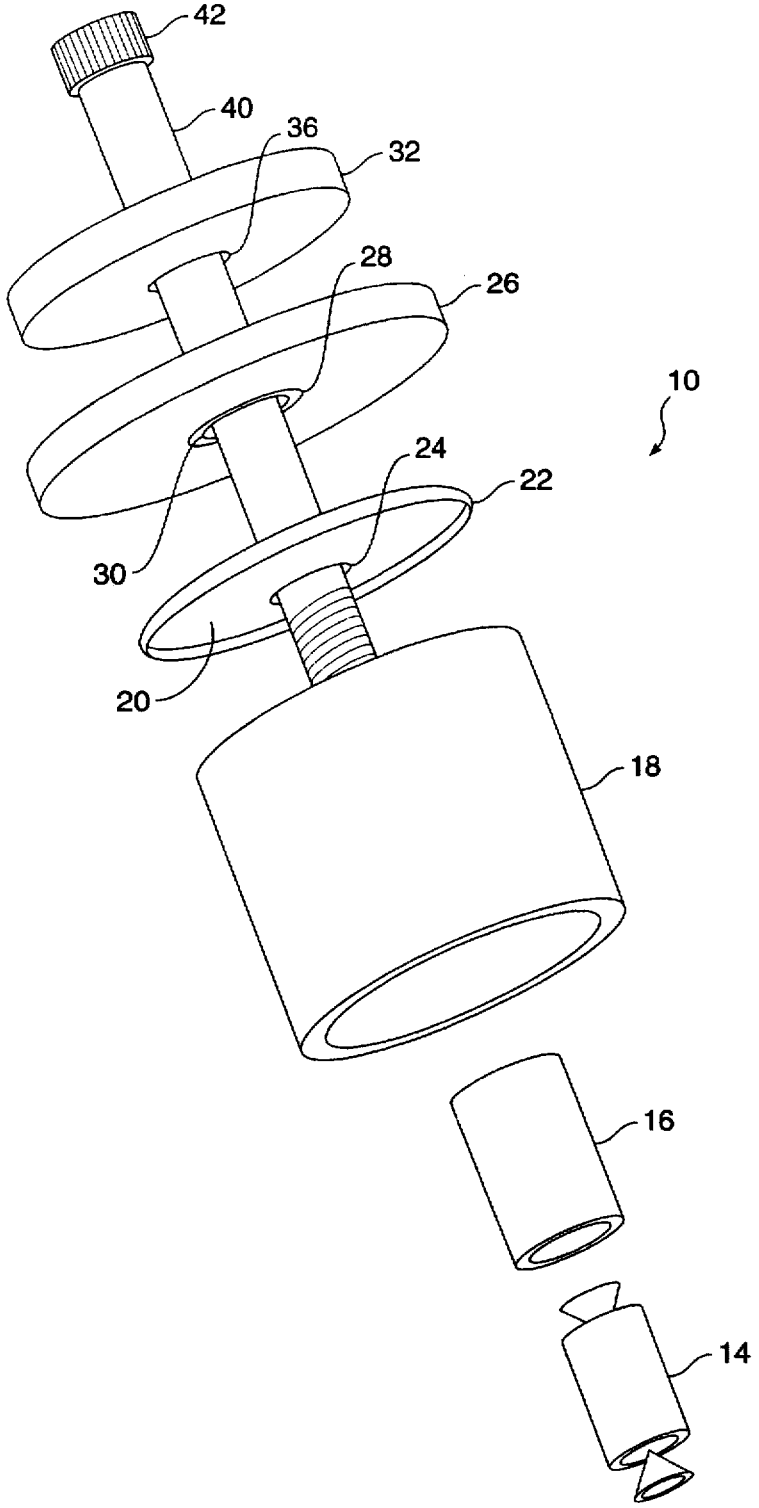
FIG. 1 is an exploded perspective drawing of the door stop according to a presently preferred embodiment of the present invention.
Figure 2:
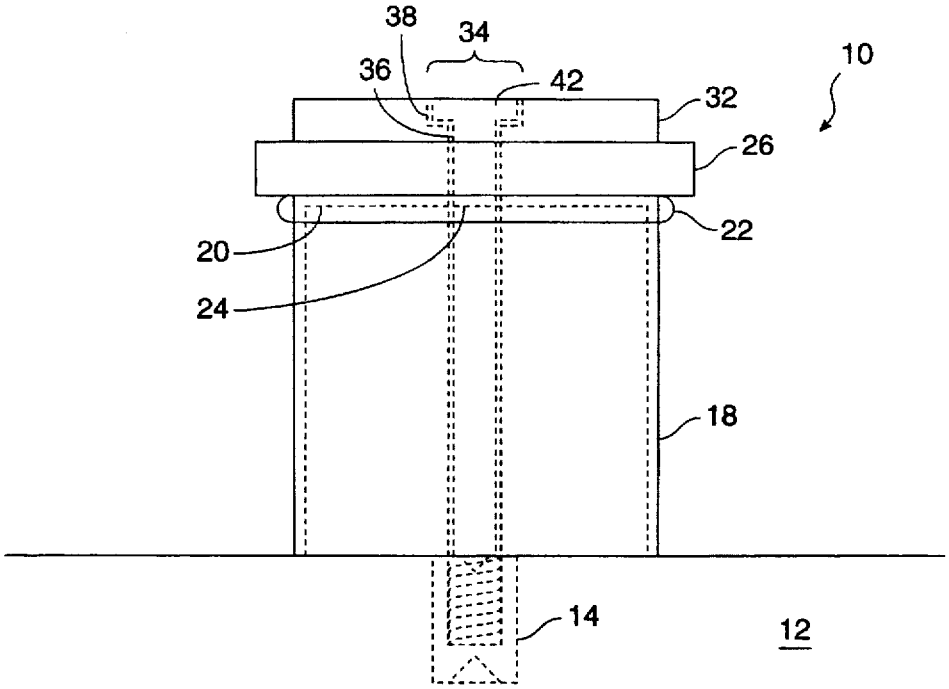
FIG. 2 is a front elevational view of a presently preferred embodiment of the doorstop of the present invention fastened to the surface of a floor.
Figure 3:
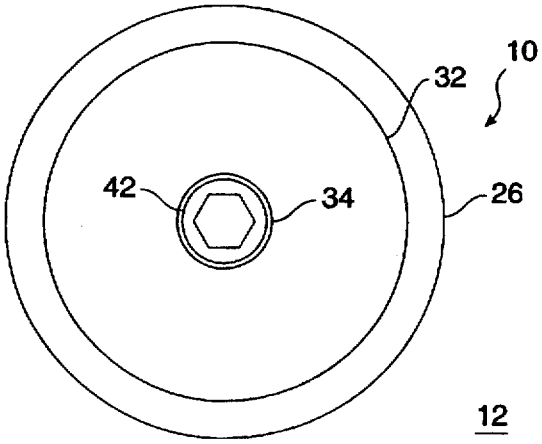
FIG. 3 is a top view of a presently preferred embodiment of the door stop of the present invention.

FIGS. 1–3 show doorstop 10 which mounts to floor 12 with an expansion nut anchor or similar device 14 according to a presently preferred embodiment of the invention. FIG. 1 is an exploded diagram showing the components of the doorstop 10 as they would be assembled. While an expansion nut 14 is presently preferred for anchoring doorstop 10 to concrete-type floors, wood screws may be used to anchor doorstop 10 to wood floors and other conventional anchors may be also be used as would be recognized by those of ordinary skill in the art. Expansion nut anchor 14 is preferably disposed in a hole formed by conventional means in the surface of the floor 12, wherein the exposed surface of the expansion nut anchor 14 is flush with the surface of the floor. Like most nuts, expansion nut anchor 14 has an inner threaded surface. When a bolt is threaded into expansion nut anchor 14, the components of expansion nut anchor 14 are arranged so that expansion nut anchor 14 expands to make a tight fit in the hole in the surface of floor 12. According to a presently preferred embodiment, expansion nut anchor 14 is Part No. 9515 manufactured by Rawl Plug Co., New Rochelle, N.Y. Those of ordinary skill in the art will realize that other types of nuts may be employed to anchor doorstop 10 to the surface of floor 12 or that the surface of floor 12 itself may be threaded (e.g., where the floor is metallic).

The inner spacer 16 is disposed on the expansion nut anchor 14, and the outer spacer 18 disposed on the surface of floor 12 and concentric to inner spacer 16. As shown in FIG. 1, inner and outer spacers 16 and 18 are tubular and cylindrical in shape, though those of ordinary skill in the art will recognize that tubular shapes other than cylinders may be employed. According to a presently preferred embodiment, both inner and outer spacers 16 and 18 are 1.25 inches in length. Inner spacer 16 is preferably formed of galvanized steel and has an outside diameter of 0.54 inches. Outer spacer 18 is preferably formed of stainless steel and has an outside diameter of 1.75 inches. One of ordinary skill in the art will recognize that various other materials may be used for inner and outer spacers 16 and 18 so long as the spacers are suitably rigid. It will also be recognized that the dimensions of inner and outer spacers 16 and 18 may be altered depending on the size of doorstop 10 desired.

In the preferred embodiment, one end of inner spacer 16 is disposed on the expansion nut anchor 14, while outer spacer 18 is disposed concentrically around inner spacer 16 with one end of outer spacer 18 disposed on the surface of floor 12. A first rigid washer 20 which according to a presently preferred embodiment has a flanged portion 22 directed axially from its circumferential edge, is disposed on the other end of both inner and outer spacers 16 and 18 such that the flange 22 fits over the outside diameter of outer spacer 18. An aperture 24 is formed in first rigid washer 20 which lines up with the inside diameter of inner spacer 16. First rigid washer 20 is preferably fabricated of solid brass, though other suitably rigid materials may also be used such as stainless steel. The outer diameter of first rigid washer 20 is, according to a presently preferred embodiment of the present invention, 1.87 inches, the inner diameter of the flanged portion 22 is 1.75 inches and length or depth of first rigid washer 20 is 0.115 inches.

Disposed on top of first rigid washer 20 is a compressible disk 26 formed of a compressible material which in the preferred embodiment is neoprene rubber, although other suitably compressible materials could also be used. In the center of compressible disk 26 is formed an aperture 28 with a diameter 0.47 inches. A bushing 30 manufactured from a brass alloy having a diameter of 0.475 inches is fitted within aperture 28 of compressible disk 26. Because the diameter of bushing 30 is slightly greater than the diameter of aperture 28 of compressible disk 26, bushing 30 fits securely in aperture 28 against compressible disk 26. In the preferred embodiment, both the length or depth of compressible disk 26 and bushing 30 are 0.5 inches. The bushing is positioned so that the inside diameter is lined up with aperture 24 in first rigid washer 20. Those of ordinary skill in the art will recognize that bushing 30 may be formed of any suitably rigid material.

In the preferred embodiment, compressible disk 26 is shown to be circular in shape with an outer diameter of 2.25 inches. As readily seen in FIG. 2, compressible disk 26 overlaps first rigid washer 20. The overlap of compressible disk 26 helps to prevent damage to a door as it strikes doorstop 10. Those of ordinary skill in the art will recognize that although presently preferred, compressible disk need not be circular in shape.

Disposed on compressible disk 26 is a second rigid washer 32 having a diameter less than compressible disk 26. In the preferred embodiment, second rigid washer 32 has a diameter of 1.25 inches and a length of 0.375 inches and is preferably fabricated of stainless steel, though other suitably rigid materials may also be used. In the center of second rigid washer 32 is formed a stepped aperture 34 such that a first portion 36 of stepped aperture 34 passes completely through second rigid washer 32 and a second portion 38 of stepped aperture 34 is formed into second rigid washer 32 to only a depth of 0.315 inches. Stepped aperture 34 is formed in second rigid washer 32 so that when bolt 40 is passed though the second rigid washer 32, bushing 30 in compressible disk 26, first rigid washer 20 and inner spacer 16 and threaded into expansion nut anchor 14 that the head 42 of bolt 40 will seat into second portion 38 of stepped aperture 34 and be flush with or contained below the upper surface of second rigid washer 32.

As can be seen from FIG. 3, according to one presently preferred embodiment of the invention, head 42 of bolt 40 is formed so it may be fitted with a wrench known by those of ordinary skill in the art as an Allen wrench to thread bolt 40 into expansion nut anchor 14. Using a bolt 40 which requires an Allen wrench and is flush with top surface of second rigid washer 32 makes doorstop 10 more tamper resistant than a bolt requiring a more conventional tool such as a flathead or Phillips screwdriver. Though it should be appreciated, that if it were so desired, a bolt 40 requiring a flat head or phillips screwdriver to thread it into expansion nut anchor 14 could be employed. Those of ordinary skill in the art will also readily recognize that a bolt requiring other types of "keyed" tools to fasten doorstop 10 to the surface of floor 12 may also be employed. To set the desired compression, a torque wrench is preferably used. Those of ordinary skill in the art will readily understand the manner of operating a torque wrench.

In the preferred embodiment, as bolt 40 is thread into expansion nut anchor 14, compression is created along a line including second portion 38 of stepped aperture 34 in second rigid washer 32, bushing 30, first rigid washer 20 and inner spacer 16. As greater amounts of torque are applied to bolt 40, the compression increases and through the mechanical action of first rigid washer 20, outer spacer 18 is also loaded or put under compression. Consequently, doorstop 10 becomes increasingly secured to the surface of floor 12 and also becomes increasingly rigid as well. Compressing the outer spacer 18 serves to protect the doorstop 10 from damage when it is subjected to a moment or rotational force from a door or other object. According to a presently preferred embodiment of the present invention as described and shown herein, a torque of 60 ft.lbs. is applied to bolt 40 for desired operation. As described above, it is preferable to set the compression of outer spacer 18 using a torque wrench, alternatively, outer spacer 18 may be compressed by applying an undetermined or random amount of torque or until the upper limit imposed by inner spacer 16 and bushing 30 is reached.

Figure 4:
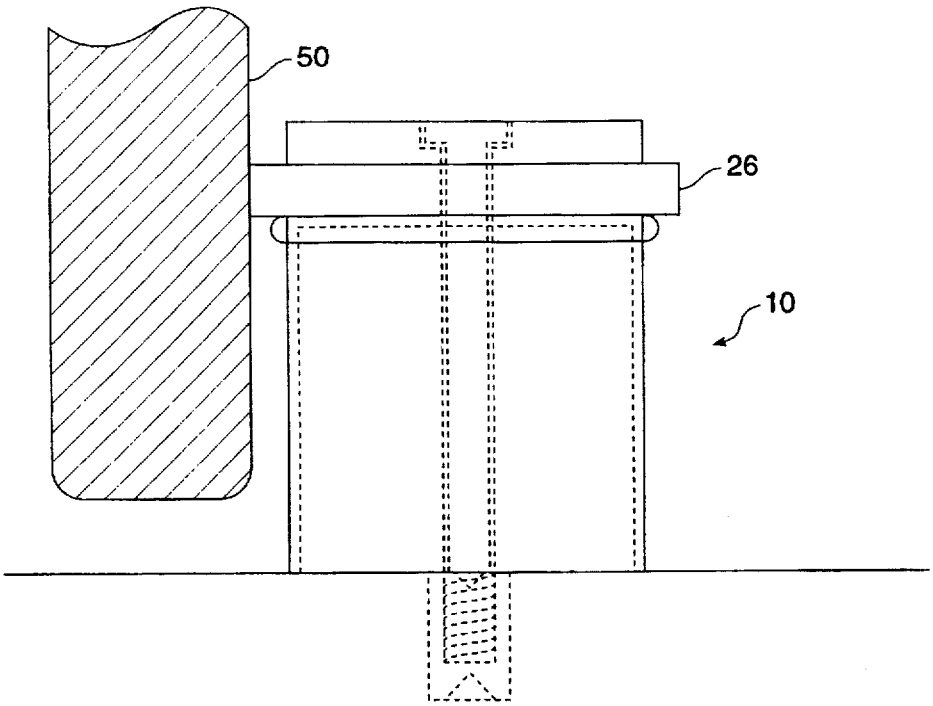
FIG. 4 is a side view of a presently preferred embodiment of the doorstop of the present invention fastened to the surface of a floor and in contact with a door.

In FIG. 4, an exemplary use of door stop 10 in conjunction with a door 50 is shown. It can be seen that as the door 50 comes into contact with doorstop 10 that contact is made between compressible disk 26 and door 50 such that damage to door 50 is minimized.

Figure 5:
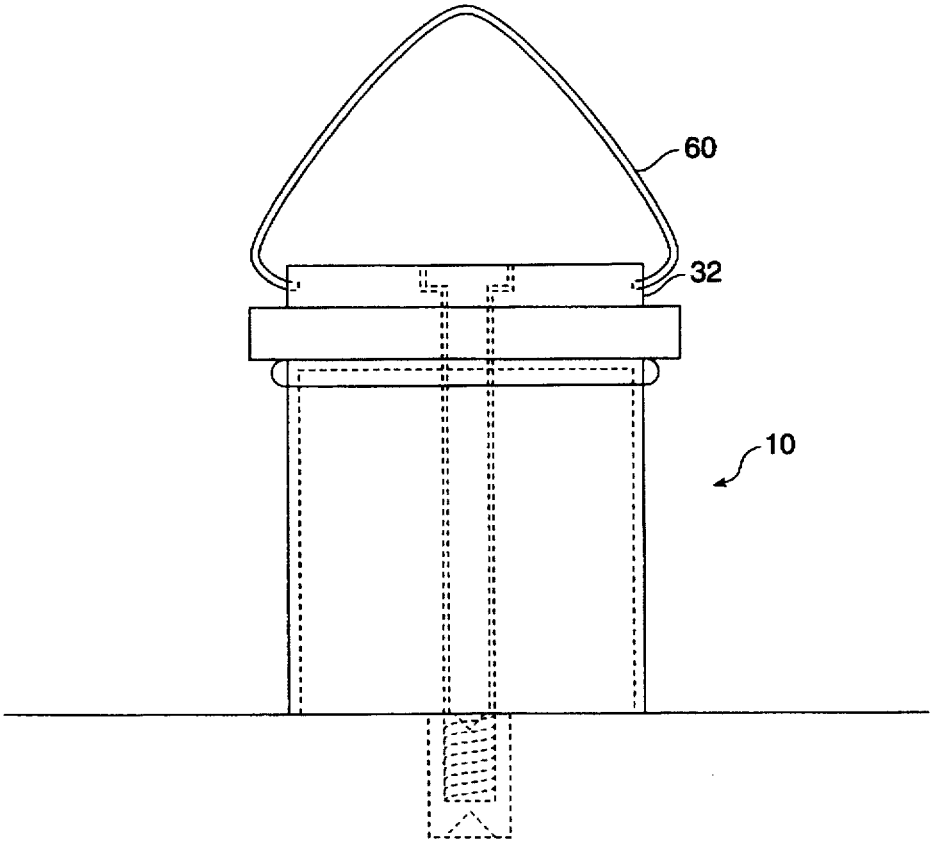
FIG. 5 is a side view of an alternative embodiment of the doorstop of the present invention fastened to the surface of a floor and shown with a bale which may be used to secure a hook to the door.
Figure 6:
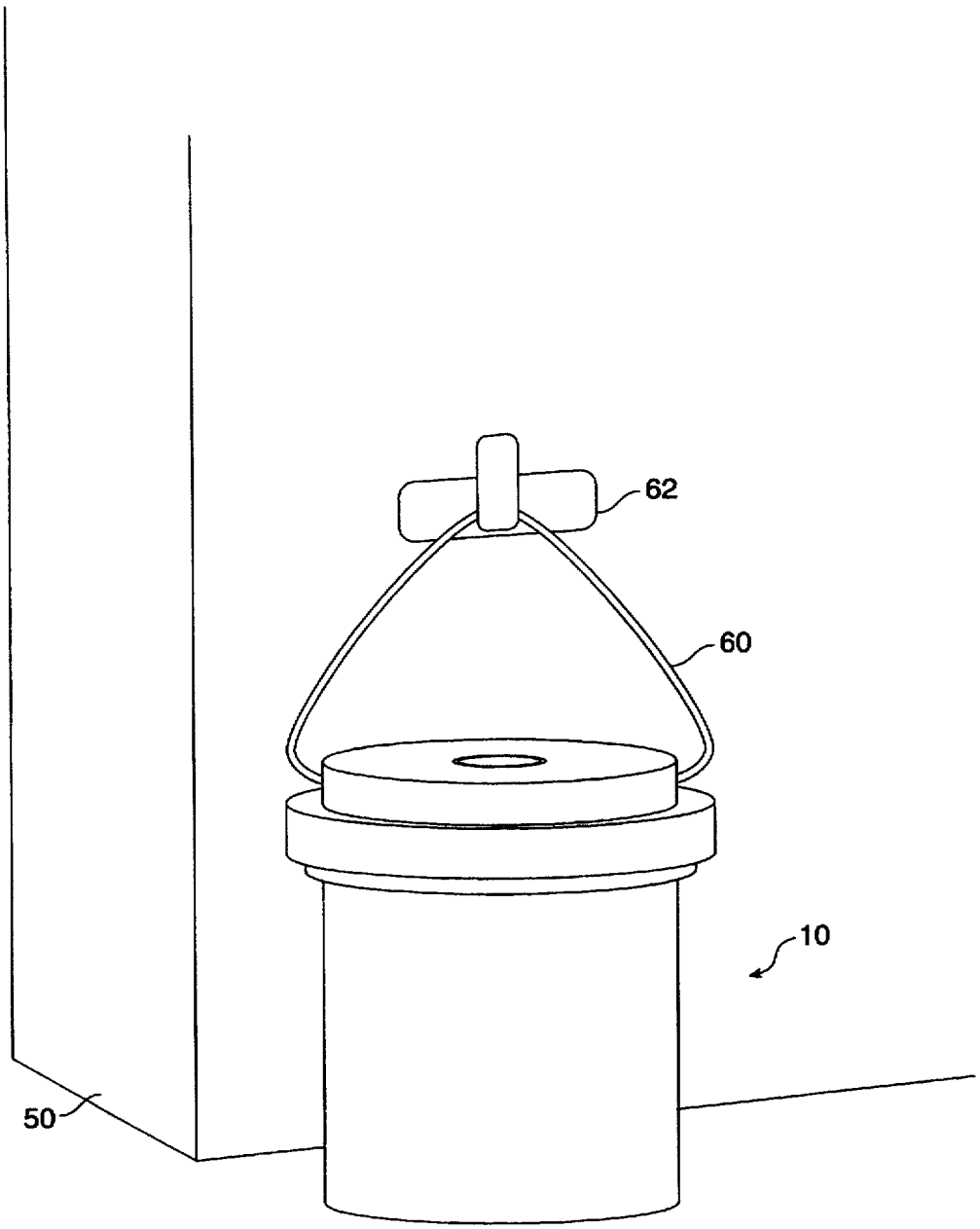
FIG. 6 is a side view of an alternative embodiment of the doorstop of the present invention fastened to the surface of a floor and shown with a bale attached to a door.

In an alternative embodiment of the present invention, doorstop 10 is shown in FIG. 5, and as described in FIGS. 1, 2 and 3 with a bale 60 attached to the radial edge of second rigid washer 32. By employing bale 60 and a bale hook 62 attached to door 50 as shown in the illustrative embodiment of FIG. 6, doorstop 10 may also be employed to hold door 50 in an open position.

It should be appreciated that although in the preferred embodiment inner and outer spacers 16 and 18, first rigid washer 20 and bushing 30 are employed, that various alternate embodiments of the present invention employing some of these elements are also possible. In the preferred embodiment, doorstop 10 is simply formed and has an aesthetically pleasing design, yet provides an extremely durable doorstop 10 able to withstand very high impacts and which is securely fastened to the surface of a floor 12.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A doorstop for mounting on a surface in proximity to a door, said door stop comprising:

a first rigid washer disposed over the surface;

a disk of a first height formed of a compressible material and having a first aperture formed therein disposed over said first rigid washer;

a bushing of said first height disposed in said first aperture;

a second rigid washer disposed over said disk and said bushing;

a bale attached to a radial edge of said second rigid washer; and fastening means for fastening said first rigid washer said disk and said second rigid washer to said surface, said fastening means including means for compressing said first rigid washer to a selected compression, wherein said first rigid washer has a cylindrical share having a first diameter, said disk has a cylindrical shape having a second diameter and said first diameter is less than said second diameter.

2. A door stop for mounting on a surface in proximity to a door, said door stop comprising:

an inner spacer having a first end and a second end, said first end disposed over the surface;

an outer spacer having a first end and a second end, said first end disposed over the surface, said outer spacer disposed around said inner spacer;

a first rigid washer disposed over said second ends of said inner and outer spacers;

a disk of a first height formed of a compressible material and having a first aperture formed therein disposed over said first rigid washer;

a bushing of said first height disposed in said first aperture;

a second rigid washer disposed over said disk; and fastening means for fastening said inner spacer, said outer spacer, said first rigid washer, said disk and said second rigid washer to said surface, said fastening means including means for compressing said outer spacer to a selected compression.

3. A door stop according to claim 2 wherein said fastening means comprises a threaded bolt passed thorough a second aperture in said inner spacer, a third aperture in said first rigid washer, said bushing and a fourth aperture in said second rigid washer and adapted to engage a mating thread disposed within the surface.

4. A door stop according to claim 3 wherein said fourth aperture is formed in a recessed portion of said second rigid washer.

5. A door stop according to claim 2 wherein said fastening means comprises a threaded bolt passed thorough a second aperture in said inner spacer, a third aperture in said first rigid washer, said bushing and a fourth aperture in said second rigid washer and adapted to engage a threaded surface.

6. A door stop according to claim 5 wherein said fourth aperture is formed in a recessed portion of said second rigid washer.

7. A door stop according to claim 2 wherein said fastening means comprises a threaded bolt passed thorough a second aperture in said inner spacer, a third aperture in said first rigid washer, said bushing and a fourth aperture in said second rigid washer and adapted to engage an expansion nut anchor disposed within the surface.

8. A door stop according to claim 7 wherein said fourth aperture is formed in a recessed portion of said second rigid washer.

9. A doorstop according to claim 2 wherein said first rigid washer has a cylindrical shape of a first diameter, said disk has a cylindrical shape of a second diameter and said first diameter is less than said second diameter.

10. A doorstop according to claim 2 wherein said second rigid washer has a cylindrical shape of a first diameter, said disk has a cylindrical shape of a second diameter and said first diameter is less than said second diameter.

11. A doorstop according to claim 2 wherein said first rigid washer includes a flanged portion fitted over said outer spacer.

12. A doorstop according to claim 2 further including a bale attached to a radial edge of said second rigid washer.

13. A method for fastening to a surface a doorstop having an inner spacer having a first end and a second end, said first end disposed over said surface, an outer spacer having a first end and a second end, said first end disposed over said surface, said outer spacer disposed around said inner spacer, a first rigid washer disposed over said second ends of said inner and outer spacers, a disk of a first height formed of a compressible material and having a first aperture formed therein disposed over said first rigid washer, a bushing of said first height disposed in said first aperture, a second rigid washer disposed over said disk and fastening means for fastening said inner spacer, said outer spacer, said first rigid washer, said disk and said second rigid washer to said surface, said method comprising the steps of:

mounting a wrench to the fastening means;

rotating the fastening means with said wrench to compress the outer spacer until limited by the inner spacer and the bushing.

* * * * *